US005352113A

United States Patent [19]

Alvarez

[11] Patent Number: 5,352,113

[45] Date of Patent: Oct. 4, 1994

[54] JAMB CUTTER

[76] Inventor: Michael A. Alvarez, 6980 Varna Ave., Van Nuys, Calif. 91405

[21] Appl. No.: 177,207

[22] Filed: Jan. 4, 1994

Related U.S. Application Data

[63] Continuation of Ser. No. 833,776, Feb. 11, 1992, abandoned.

[51] Int. Cl.[5] ..... B05C 17/10

[52] U.S. Cl. ..... 425/458; 15/235.7; 15/235.8; 425/470

[58] Field of Search ..... 15/235.3, 235.4, 235.5, 15/235.6, 235.7, 235.8, 236.01, 236.09; 425/87, 458, 460, 470

[56] References Cited

U.S. PATENT DOCUMENTS

| | | | |
|---|---|---|---|
| 761,242 | 5/1904 | Meyers | 15/235.7 |
| 833,675 | 10/1906 | Chezem | 15/235.3 |
| 849,681 | 4/1907 | Hauver | 425/458 |
| 988,457 | 4/1911 | Glasscock | 15/235.8 |
| 1,297,082 | 3/1919 | Brown | 425/DIG. 121 |
| 1,348,639 | 8/1920 | Grundmann | 15/235.3 |
| 2,162,861 | 6/1939 | Polak | 15/235.3 |
| 2,179,563 | 11/1939 | Sassano | 15/235.8 |
| 2,222,877 | 11/1940 | Neal | 15/235.8 |
| 2,526,401 | 10/1950 | Oscar | 15/235.8 |
| 2,618,004 | 11/1952 | Heyder | 15/236.01 |
| 2,906,114 | 9/1959 | Buckley | 15/235.8 |
| 3,758,909 | 9/1973 | Granger, Jr. | 15/235.8 |
| 4,810,128 | 3/1989 | Kleinemas | 425/458 |
| 5,057,002 | 10/1991 | Whited et al. | 425/458 |

*Primary Examiner*—James Mackey
*Attorney, Agent, or Firm*—Michael J. Ram

[57] ABSTRACT

An assembly (15) of a tool (16) and straight edge (27), with a cutting edge (38) extending beyond a member (17) of tool (16) which lies along straight edge (27). The member including cutting edge (38) is supported by member (17) and cuts excess wet cement from a supporting base (22) to form a surface with the cement. A T-bar (37) having a leg (39) is included in the member having cutting edge (38). Edge (38) removes a web 20 of excess fluent material as member (17) slides upwardly along straight edge (27). A distal end (55) of T-bar (37) removes a web (56) of excess material from an interior supporting base (22) in another application. A member (24) adjusts the cutting length of edge (38), being mounted along an edge (19) of tool (16), while a flange (27f) is included in straight edge (27) for providing a guide by which member (17) and cutting edge 38 shift uniformly upwardly to remove excess 20 of fluent material. T-bar (37) is reversible in its support (40) to provide another manner of use of assembly (15).

8 Claims, 2 Drawing Sheets

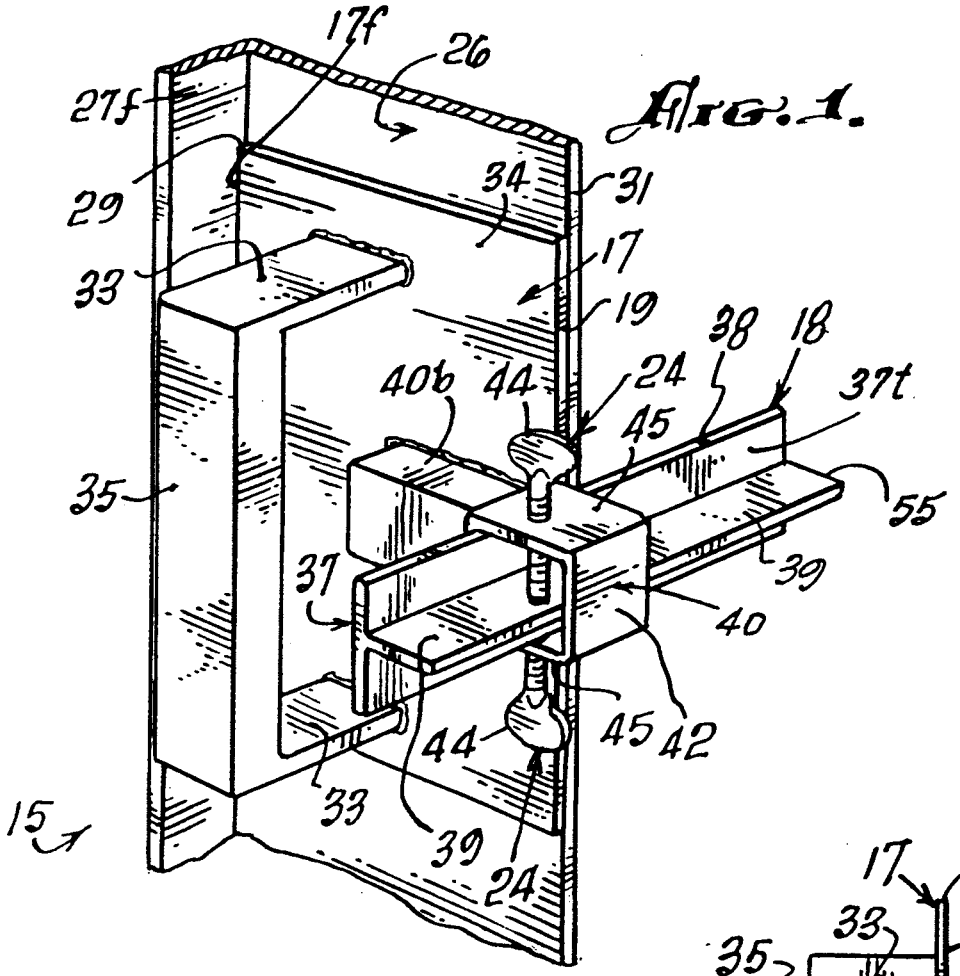
FIG. 1.
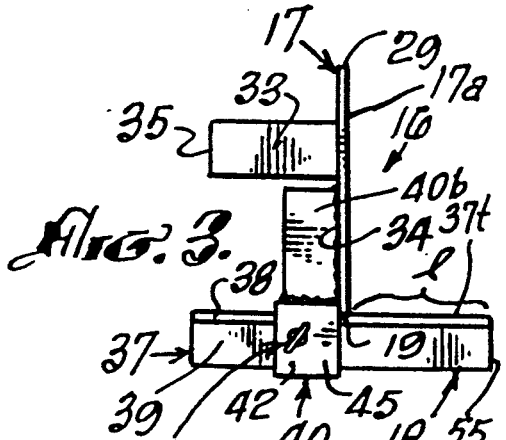
FIG. 3.
FIG. 2.
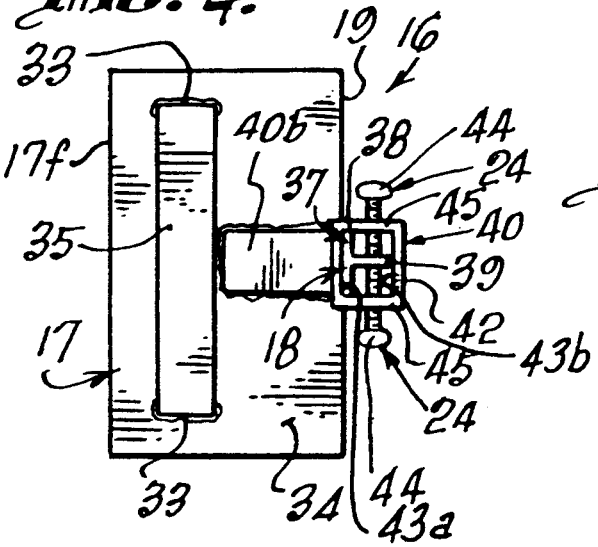
FIG. 4.
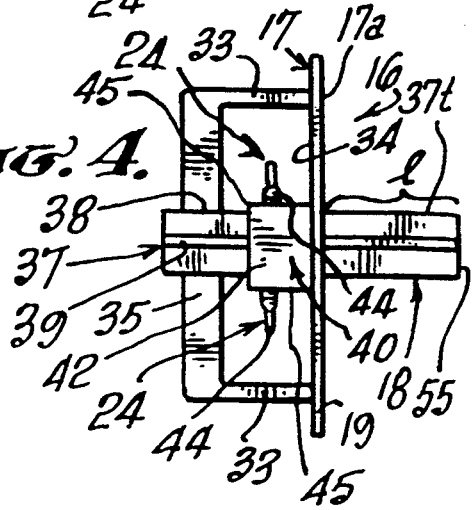

27f
26
50
48
51
47
27
53
21
21
33
17
34
29
19
38
17f
44
53
37
40b
45
37t
39
15
40
42
35
45
18
33
44
16
20
31

26
17f
21
31
19
56
27
29
17
27f
45
33
40b
61
44
42
40
38
35
18
37t
37
15
20
39
33
34
44
59
60
58
57

26
27
P1
31
27f
21
62
19
15
17
40
42
29
37
20
18
40b
65
17f
38
39
35
65
63
P2

29
34
17
33
19
15
17f
40b
44
38
40
45
39
37
37t
35
42
18
44
43a
33
44

JAMB CUTTER

This is a continuation of application Ser. No. 07/833,776, filed Feb. 11, 1992, now abandoned.

TECHNICAL FIELD

This invention pertains to a cutting or shaping tool for surfacing a wall, and particularly to an assembly of elements for cutting off an excess of fluent material to attain a desired depth or thickness for the wall, such as for example, an entry-way wall for a shower stall.

BACKGROUND ART

Tools in similar classes of art are disclosed in the following U.S. Pat. Nos.: 1,297,082; 2,222,877; 2,526,401; 2,906,114; 5,057,002.

SUMMARY OF THE INVENTION

The invention is embodied in an assembly of a slidable member that faces and shifts along an elongated member having a guiding line, and a cutting edge element or tool which when applied to fluent material disposed in a wall layout arrangement, provides for ease of working, shaping and cutting the fluent material to a desired depth or thickness, to attain a configured wall. The fluent material is known in the trade as "mud" or wet cement that is easily workable to result in a thickness of a desired dimension, the excess of which being removed by operation of the cutting tool.

The tool's cutting edge works at a right angle to the plane of its facing member as the latter slides along and is guided by the elongated member that is in a fixed location spaced from and parallel to the wall being formed.

In another application of the invention, the cutting edge element includes an additional cutting edge at an end distal from the location of its support on the facing member, so that such distal cutting edge provides for removing excess fluent material from a cavity or recess being formed in a wall, the recess ultimately being useable as a retaining chamber for soap, a shampoo bottle, or the like.

In a third manner of use, the elongated member is held firm between two (2) points in a location, say, to the right of or in front of a surface and wall being formed by the fluent material, via-a-vis such member engaging a previously hardened wall to the rear or left of a surface and wall being formed, the cutting edge element being reversed in its support on the facing member in order to effect a cutting of the fluent material to its desired thickness in forming the surface.

Means to adjust the length of the cutting edge member is also provided.

An object of this invention is to provide a tool that efficiently and effectively works fluent material applied to a supporting base for forming a wall.

Another object of this invention is to provide an inexpensive and lightweight apparatus assembly for manual application to the formation of walls, such as door jamb and shower stall entry-way walls.

A still further object of the invention is to form a completed fluent-material wall by ease of manipulation of the subject matter of this invention.

These and other objects and advantages of the invention will become more apparent upon a full and complete reading of the following description, the appended claims thereto, and the accompanying drawing comprising eight (8) FIGURES on two (2) sheets.

BRIEF DESCRIPTION OF THE DRAWINGS

FIG. 1 is a perspective view of an apparatus assembly embodying my invention.

FIG. 2 is a front view of the tool 16 illustrated in FIG. 1.

FIG. 3 is a top view of FIG. 1.

FIG. 4 is a side view of the tool 16 illustrated in FIG. 2.

BEST MODE OF CARRYING OUT THE INVENTION

Figure 5:
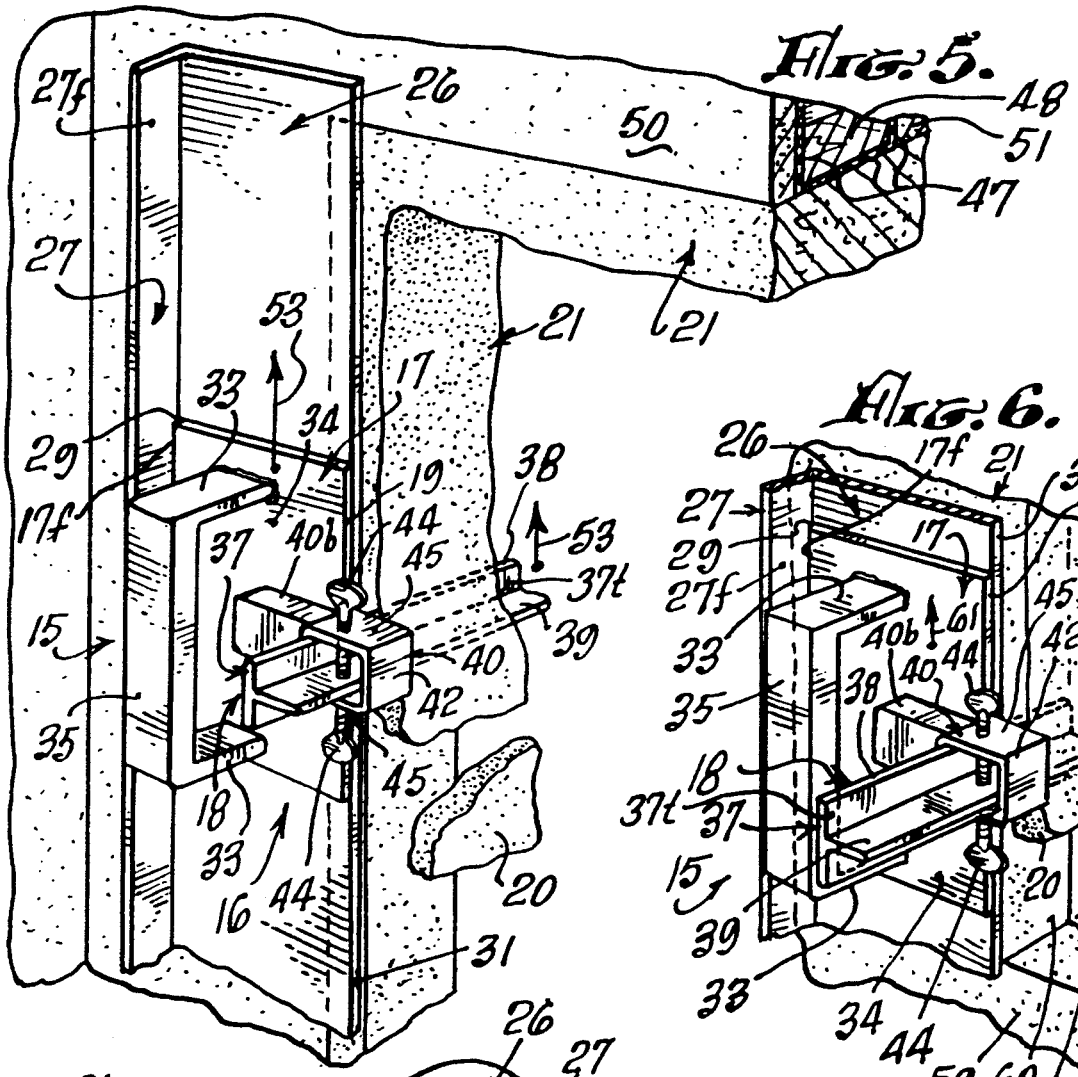
FIG. 5 is a perspective view of the apparatus assembly in one manner of operation.

Referring now to the drawing FIGURES wherein reference characters therein correspond to like numerals hereinafter, an apparatus assembly 15, for use in forming an outside corner, such as an entry way, is illustrated in FIG. 1, and which incorporates the subject matter of this invention. Assembly 15 comprises generally a tool 16 having a slidable face member 17 for shifting the position of a cutting means 18 mounted along its first edge 19 through a web 20 (FIGS. 2, 6) of excess fluent material 21 applied to a supporting base 22 (FIG. 5), means 24, such as a clamp or bolts for adjusting the cutting length l of the cutting means 18 beyond slidable member 17, and an element comprising flat support means 26 along which a compact surface 17*a* of face member 17 slides, and a guide means 27 for guiding the sliding movement of face member 17 and cutting means 18 in operation of assembly 15. In the construction trades, the element comprising support means 26 and guide means 27 is referred to as a straight edge. The placement of guiding means 27 in such operation (i.e., forming an outside corner) determines the desired depth or thickness of fluent material 21 to be left on the supporting base 22 as the cutting means 18 is applied to such material as will become apparent in the description following hereinafter.

Slidable face member 17 is flat and includes a second edge 29 that cooperatively engages guide means 27 which is illustrated in the form of a flange 27*f* as face member 17 cooperatively engages support means 26, with its second edge 29 cooperatively engaging flange 27*f*. First edge 19 lies in a plane in alignment with a terminal edge 31 on support means 26. Spaced handle stems or arms 33 are securely mounted to the backside 34 of face member 17 so that a handle or grip 35 securely mounted thereto may be grasped by a user operating the assembly to carry out the practice of the invention.

The cutting means 18 comprises an elongated rigid T-bar 37 having a cutting edge 38 member formed on the top member 37*t* of the T and a leg 39 (stem of the T). A support 40 for cutting means 18, in the form of an open-ended square-like box or housing 42 that is an integral extension of a block 40*b* suitably secured to backside 34, is secured to backside 34 in such a manner that the cutting plane of edge 38 lies substantially in the first plane with the edge 19 of facing member 17. As best shown in FIGS. 1 and 2, a portion of the T-bar 37 is positioned in housing 42 with the top member 37*t* in contact with a first interior or positioning surface 43*a* of the housing and in the plane of first edge 19 and the base of leg 39 contacts a second interior surface 43*b* spaced from and parallel to the first interior surface 43*a*. The width of face member 17 equates to, i.e., is co-extensive with, the width of means 26, as illustrated in FIG. 1, thereby aligning edges 19, 31 with one another. The cutting length l of the T-bar 37 extends beyond member 17 in a direction away from handle or grip 35 for application to the excess web 20 of fluent material 21.

Securing means 24 for adjusting the cutting length l of cutting edge 38 beyond member 17 is provided by one screw or a pair of opposing horizontally-oriented set screws 44 which are threaded through one or more opposing sides 45 of box 42, so that they can provide pressure on the T-bar's stem 39 within thereby lock the T-bar to the box 42 for any given cutting length l desired beyond member 17. Such cutting length l in practice preferably is slightly more than the width of the excess web 20 of fluent material 21 applied to the wall.

Guide means 27 in the preferred embodiment takes the form of a straight, rigid flange 27*f*, extending preferably along the full length of the support means 26 along which facing member 17 slides.

The use of this assembly 15 occurs after fluent material 21, referred to as "mud" or wet cement in the construction trades, has been applied to a supporting base 22. The supporting base takes generally one of two forms. It may be the conventional wire mesh 47, FIG. 5, attached to 2×4 studs 48 forming a wall's foundation. Or, the supporting base 22 may take the form of a previously hardened (cement) wall 50, also illustrated in FIG. 5, and to which a web of fluid material/wet cement 21 is applied. An adequate amount or web of fluent material 21 is applied to hardened wall 50, FIG. 5. A desired thickness or depth thereof can be shaped or formed by a cutting operation using the invention on the web 20 of excess fluent material. Support means 26 is mounted to another hardened wall 51 such that its terminal edge 31 is put into the plane at which the applied web 20 of excess fluent material 21 is to be removed in the cutting operation performed by cutting means 18. Terminal edge 31 of the straight edge is positioned a distance from the plane of the hardened wall 50, such distance being equal to the depth or thickness desired in the fluent material being worked by means 18 (i.e., the terminal edge 31 establishes the depth of fluent material 21 to be left on the wall 50 after completion of the cutting operation).

Thereafter, second edge 29 of face member 17 is caused to engage flange 27*f* and the contact surface 17*f* of face member 17 itself is caused to engage the contact surface 17*f* of support means 26. A desired length l for the T-bar 37 has previously been obtained by adjusting its full length relative to box 42 in order to obtain length l by tightening set screws 44. The operator while grasping handle 35 slides member 17 over support means 26 in the direction shown by arrows 53, FIG. 5, as its second edge 29 engagingly cooperates with flange 27*f*. Cutting edge 38 removes the web 20 of excess fluent material 21 applied to wall 50, while simultaneously shaping or forming the surface of the wall to conform to the configuration and thickness or depth desired over wall 50.

In assembly of apparatus 15, the straight edge comprising support and guide means 26, 27 is of conventional form that is commercially available, while facing member 17 is fabricated in known manner from suitable metal. Handle 35 and its stems or arms 33 are preferably made integrally to each other and are welded to backside 34, as is the support 40 and its box 42, the latter's tapped holes for screws 44 being drilled before or after such welding. The T-bar 37 is inserted through the open ends of box 42 and thereafter, screws 44 applied to the leg 39 via such threaded holes to secure it within box 42 at any desired position by movement therein of its full length.

Figure 6:
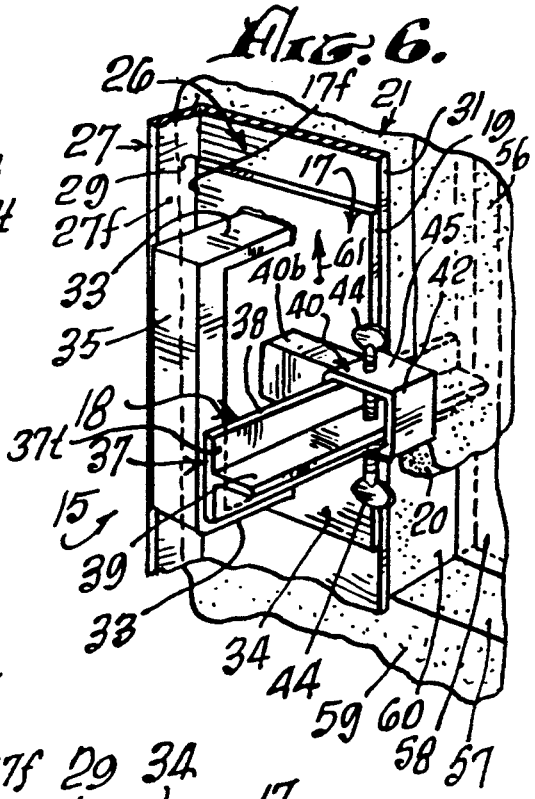
FIG. 6 is a perspective view of the apparatus assembly in another manner of operation in addition to that shown in FIG. 5.

Turning to FIG. 6, another manner of use of assembly 15 is illustrated. The distal end 55 (FIGS. 3, 4) of T-bar 37 is utilized to cut an interiorly deposited web 56 of fluent material applied in the rear of a recess 57 and from which web 56 a rear surface 58 is formed in a back or side wall 59 of a shower stall. While the cutting means 18 is removing a web 20 of excess material to form an inwardly extending surface 60 for the chamber, its distal end 55 (FIGS. 3, 4), particularly the T-bar's leg 39, is cutting off a web 20 of excess from the interiorly-deposited web 56 of material forming the rear surface 58 of the chamber, as tool 16 shifts upwardly in the direction shown by arrow 61. It is to be noted that although described here as but one step of cutting fluent material 21, 56, to form surfaces 60, 58, respectively, in the use of assembly 15, in actual practice, distinct steps are used for cutting material 21 in forming surface 60 and for cutting material 56 in forming surface 58.

Figure 8:
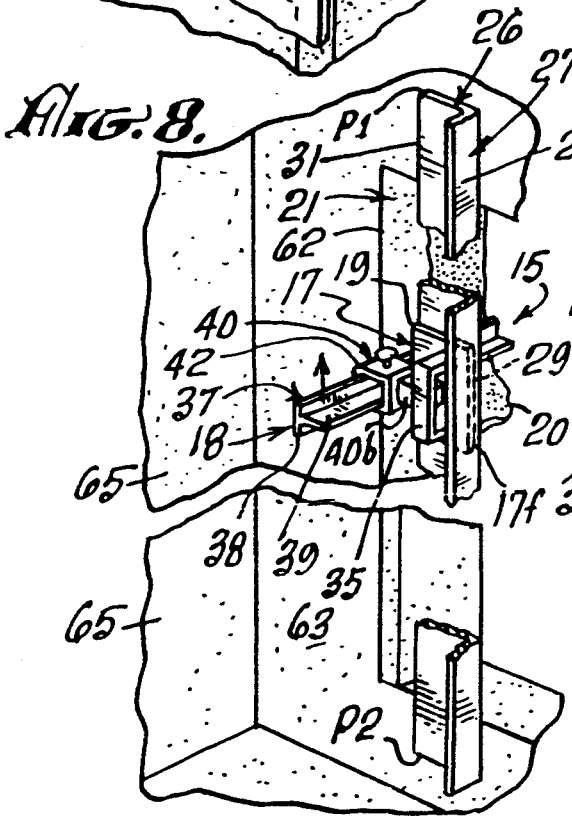
FIG. 8 is a perspective view of the FIG. 7 tool in place in the assembly for carrying out another manner of practice of the invention.
Figure 7:
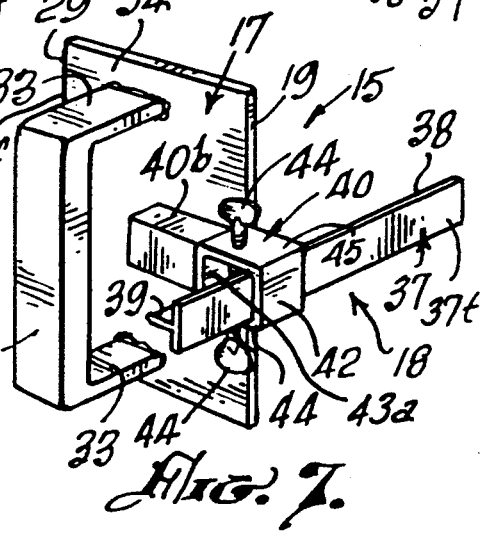
FIG. 7 is a perspective view of the tool with its cutting edge element reversed in its position in its support.

FIGS. 7 and 8 illustrate another manner of use of the invention. Here, T-bar 37, FIG. 7, is reversed in the open-ended support box or housing 42. As best shown in FIGS. 7 and 8, a portion of the T-bar 37 is positioned in housing 42 with the base of the leg 39 in contact with the first interior or positioning surface 43*a* of the housing and in the plane of first edge 19 and the top member 37*t* contacts a second interior surface 43*b* spaced from and parallel to the first interior surface 43*a*. The T bar is secured therein by set screws 44 with the desired length l extending beyond member 17. Tool 16 is then rotated 180°, as shown in FIG. 8, so that the T-bar's cutting edge 38 faces the workable fluent material 21 applied to an entry-way wall 62 of, say, a door jamb or shower stall 63. The assembly 15 operates in the same manner as described above and shown in FIG. 5 with the exception that support means 26 engages two fixed points P1, P2, FIG. 8, in front of the workable fluent material. The points P1, P2 are fixed on previously hardened wall and their locations are readily determinable, knowing the desired depth of fluent material to be reached (from the amount applied to wall 62) and the distance X (FIG. 8). This manner of use is better suited for application where the horizontal distance is very narrow between an adjacent wall 65 and the wall surface 66, FIG. 8, which defines the plane at which the fluent material was cut by operation of the invention.

It should be understood that assembly 15 can be used to cut fluent material in a horizontal manner as well as that shown in the accompanying FIGURES wherein cutting of vertically-oriented surfaces is illustrated. A suitable metal such as light-weight aluminum is preferred for all of the above described elements, their dimensions being readily apparent from the dimensions of the work area in which practice of assembly 15 is to be carried out.

The invention is not to be limited to the exact arrangement of parts or elements shown in the accompanying drawing or described in this specification, as various changes and modifications in the details of construction may be resorted to without departing from the spirit or scope of the invention. Therefore, only insofar as the invention has particularly been pointed out in the accompanying claims is the same to be limited.

INDUSTRIAL APPLICABILITY

The invention is useful in the construction trades.

I claim:

1. An assembly for removing excess fluent material applied to a wall to form an outer corner, wherein the assembly comprises a face member which includes a housing mounted thereto, a cutting means held in said housing and a support means for guiding the face member and cutting means, said face member having a first edge and second edge parallel thereto, said first edge and second edge being separated by a width for said face member, the cutting means being movably mounted on said face member at its first edge by placement in the housing in a first or second alternate position, said cutting means extending at an angle from said face member for acting on the excess fluent material, the support means having a flat surface with a width that is substantially equal to the width of said face member and along which said face member slides, said width being defined by a terminal edge and a guide means, the guide means being spaced from and parallel to the terminal edge, said guide means comprising a flange for guiding said face member as it slides along said support means with the second edge against the flange, the cutting means first alternate position locating a flat top portion of the cutting means in contact with the first edge of the face member and the cutting means second alternate position locating the flat top portion parallel to, but spaced from, the first edge with a leg of the cutting means in contact with the first edge of the face member, the cutting means being mounted to the face member so that when the support means is positioned on a supporting surface a desired amount of fluent material placed on a second surface perpendicular thereto can be removed by the cutting means as the face member is slid along the flat surface of the support means.

2. The assembly of claim 1, wherein the housing is an open ended box-shaped structure comprising four sides surrounding an open central space, one of said four sides constitutes a positioning side, said positioning side being aligned with the first edge, the open space being positioned outward of both the second edge and the first edge, said cutting means mounted in the box-shaped structure comprising a length of a T-bar having the flat top portion and the leg projecting from said open space, the flat top portion of the T-bar forming a cutting edge for the excess fluent material, and securing means mounted on at least one side of the box-shaped structure for holding the T-bar fixed in the first or second alternate position within the box-shaped structure and for adjusting the length of said T-bar which extends beyond the face member.

3. An assembly for forming a first wall perpendicular to a second wall by removing excess fluent material applied to the first wall, the assembly comprising a face member having a first edge and a second edge parallel to the first edge, said second edge separated from the first edge by a distance constituting the width of said face member, and a thickness bounded by a face and a backside, a handle mounted on the backside, cutting means mounted on said face member at its first edge, in an operator selected first or second alternate orientation, said cutting means extending at a right angle to said face member for acting on the excess fluent material, the cutting means in its first alternate orientation having a top thereon in contact with the face member first edge, and the cutting means in its second alternate orientation having the top thereon spaced from the face member first edge, a leg depending from the top being in contact with the face member first edge, and support means having a flat surface with a width which is substantially equal to the width of said face member and along which the face of said face member slides, said support means including a flange for guiding said face member as it slides along said support means.

4. The assembly of claim 3, further having an open-ended housing mounted on the backside of the face member, said open-ended housing extending laterally from the first edge, wherein said cutting means is mounted in the housing, the cutting means being formed from a T-bar having the top and the leg depending therefrom, the T-bar being mounted therein with the top abutting an inner surface of the housing with a portion of the T-bar projecting past the plane of the face member, the top of the T-bar forming a cutting edge for the excess fluent material, and securing means mounted on said housing for adjusting the length of said T-bar which extends beyond the face member.

5. The assembly of claim 4 wherein the T-bar is mounted in the housing with the top in alignment with the first edge of the face member.

6. The assembly of claim 2 wherein the flat top portion of the T-bar is mounted against the positioning side of the box-shaped structure.

7. The assembly of claim 2 wherein the flat top portion of the T-bar is mounted against a second side of the box-shaped structure, said second side being parallel to the positioning side.

8. The assembly of claim 4 wherein the T-bar is mounted in the housing with the top spaced from but in alignment with the first edge of the face member.

* * * * *